US011772885B2

(12) United States Patent
Lawrence

(10) Patent No.: US 11,772,885 B2
(45) Date of Patent: Oct. 3, 2023

(54) LINER STRUCTURE WITH CONSTRICTABLE SIDEWALL AND METHOD TO INSTALL SAME

(71) Applicant: Freedom Manufacturing LLC, Saratoga Springs, NY (US)

(72) Inventor: Jon G. Lawrence, Porter Corners, NY (US)

(73) Assignee: Freedom Manufacturing LLC, Saratoga Springs, NY (US)

( * ) Notice: Subject to any disclaimer, the term of this patent is extended or adjusted under 35 U.S.C. 154(b) by 31 days.

(21) Appl. No.: 17/652,305

(22) Filed: Feb. 24, 2022

(65) Prior Publication Data

US 2022/0267084 A1 Aug. 25, 2022

Related U.S. Application Data

(60) Provisional application No. 63/153,454, filed on Feb. 25, 2021.

(51) Int. Cl.
*B65D 88/26* (2006.01)
*B65D 90/04* (2006.01)

(52) U.S. Cl.
CPC ..... *B65D 88/26* (2013.01); *B65D 90/046* (2013.01); *B65D 2590/046* (2013.01)

(58) Field of Classification Search
CPC . B65D 88/26; B65D 2590/046; B65D 90/046
See application file for complete search history.

(56) References Cited

U.S. PATENT DOCUMENTS 1,452,039 A * 4/1923 Gravell ..... B65D 77/06 217/3 CB
2,831,610 A * 4/1958 Dennie ..... B65D 77/065 222/105
4,635,814 A 1/1987 Jones
4,817,824 A * 4/1989 LaFleur ..... B65D 90/205 222/105
4,946,071 A * 8/1990 Poulton ..... B65B 69/0091 222/105
4,947,988 A 8/1990 Schutz
5,067,636 A 11/1991 Pfeiffer et al.
5,072,857 A * 12/1991 Coleman ..... B65D 77/068 222/105
5,154,308 A 10/1992 Larson
5,163,485 A 11/1992 Hermann
5,169,019 A 12/1992 Büdenbender
(Continued)

*Primary Examiner* — Frederick C Nicolas
(74) *Attorney, Agent, or Firm* — Matthew J. Kinnier; Hoffman Warnick LLC

(57) ABSTRACT

Embodiments of the disclosure provide a liner structure adapted for insertion within a discharge spout of a container. The liner structure may include a neck formed of a liner material and enclosing a cross-sectional area substantially equal to a cross-sectional area of the discharge spout. A collar formed of the liner material may be coupled circumferentially to an end of the neck, wherein the collar has a cross-sectional area greater than the cross-sectional area of the discharge spout. A constrictable sidewall is on the neck proximate the collar. Constricting the constrictable sidewall compresses the collar such that it is within the cross-sectional area.

20 Claims, 8 Drawing Sheets

(56) References Cited

U.S. PATENT DOCUMENTS

| | | | | | |
|---|---|---|---|---|---|
| 5,377,876 | A * | 1/1995 | Smernoff | B65D 77/065 222/105 |
| 5,385,268 | A | 1/1995 | LaFleur et al. | |
| 5,678,688 | A | 10/1997 | Schutz | |
| 5,794,670 | A | 8/1998 | LaFleur | |
| 5,836,363 | A | 11/1998 | LaFleur | |
| 5,851,072 | A * | 12/1998 | LaFleur | B65D 77/065 383/41 |
| 5,897,012 | A | 4/1999 | Sortwell | |
| 6,244,459 | B1 | 6/2001 | Bouc et al. | |
| 6,286,700 | B1 * | 9/2001 | Davidson | B65D 77/065 220/1.6 |
| 6,305,845 | B1 | 10/2001 | Navin | |
| 6,505,657 | B1 | 1/2003 | Lawrence | |
| 6,988,639 | B2 * | 1/2006 | Arch | B65D 77/061 222/105 |
| 7,140,490 | B2 | 11/2006 | Przytulla | |
| 8,746,500 | B2 | 6/2014 | Bernard et al. | |
| 9,546,039 | B1 * | 1/2017 | Lawrence | B65D 77/06 |
| 9,751,690 | B2 * | 9/2017 | Lawrence | B65D 90/047 |
| 10,125,909 | B2 * | 11/2018 | Lawrence | F17C 13/00 |
| 2004/0089667 | A1 | 5/2004 | Gargano et al. | |
| 2006/0023973 | A1 | 2/2006 | Plunkett et al. | |

* cited by examiner

LINER STRUCTURE WITH CONSTRICTABLE SIDEWALL AND METHOD TO INSTALL SAME

BACKGROUND

1. Technical Field

The present disclosure relates to liners for industrial bulk containers. More specifically, embodiments of the disclosure provide a liner discharge spout usable with valves in piping, and related methods to install a container liner.

2. Background Art

Bulk containers, including tanks and totes, are used in many applications to hold and ship fluids. Illustrative fluids may for example include industrial liquids, such as chemicals and paints, as well as consumer products such as lotions and other beauty products. Regardless, the use of bulk containers presents technical challenges. For instance, cleaning bulk containers may be difficult and time consuming. Bulk containers also present a risk of environmental harm, as well as contamination from contact with foreign substances, e.g., portions of the container. For instance, some chemical food products or similar chemicals may become unsuitable for human consumption after exposure to contaminants, e.g., within the container and/or included within the material composition of the container. Similarly, the container structure may pose a risk of premature contact of the product with outside air and hence unintended curing of its contents. Due to these concerns, governmental agencies such as the Food and Drug Administration (FDA) have set stringent standards for liquid and non-liquid products stored in containers that are to be consumed or applied to people.

In some applications, a disposable single-use or multi-use liner can be installed within a container to reduce or eliminate contamination. For example, U.S. Pat. No. 6,505,657, entitled "Container Liners and Methods of Lining Containers," issued on Jan. 14, 2003, the contents of which is hereby incorporated by reference, teaches a liner system for use with tanks, such as an intermediate bulk container (IBC). In such an application, the liner can be shaped to conform to the inner surface of the container, to not interfere with any product contained therein.

While the use of liners greatly enhances the performance, lifespan and usability of a container, liners present various challenges. One such challenge is the need to ensure that the liner is easy to install and does not interfere with the operation of the container. For example, some containers may include a discharge opening at the bottom for discharging fluids through a valve. Under certain circumstances, the liner could slip within the tank and interfere with the opening. Another challenge is the need to ensure that the liner material is compatible with the fluids held therein.

In the case of valve-regulated discharge piping, conventional liner discharge structures may have a diameter that is significantly smaller than the piping where it is used. This may cause the liner to restrict the flow of material leaving the tank. Materials that are physically capable of being formed with a discharge diameter sized for the piping are often chemically incompatible with materials held within the container. This issue may be especially pronounced when the valve is shaped to have a smaller diameter than other sections of piping.

SUMMARY

The illustrative aspects of the present disclosure are designed to solve the problems herein described and/or other problems not discussed.

Embodiments of the disclosure provide a liner structure adapted for insertion within a discharge spout of a container, the liner structure including: a neck formed of a liner material, and enclosing a cross-sectional area substantially equal to a cross-sectional area of the discharge spout; a collar formed of the liner material and coupled circumferentially to an end of the neck, wherein the collar has a cross-sectional area greater than the cross-sectional area of the discharge spout; and a constrictable sidewall on the neck proximate the collar, wherein constricting the constrictable sidewall compresses the collar such that the collar is within the cross-sectional area of the discharge spout.

Further embodiments of the disclosure provide a liner structure adapted for insertion within a discharge spout of a container, the liner structure including: a neck formed of a liner material, and enclosing a cross-sectional area substantially equal to a cross-sectional area of the discharge spout; a collar formed of the liner material and coupled circumferentially to an end of the neck, wherein the collar has a cross-sectional area greater than the cross-sectional area of the discharge spout; and a constrictable sidewall on the neck proximate the collar, the constrictable sidewall adjustable between: a first position in which the constrictable sidewall encloses the cross-sectional area of the discharge spout, and the collar extends perpendicularly outward with respect to the neck, and a second position in which the constrictable sidewall encloses less than the cross-sectional area of the discharge spout, and the collar is constricted such that an outer circumference of the collar is within the cross-sectional area of the discharge spout.

Still further embodiments of the disclosure provide a method to install a liner structure within a discharge spout of a container, the method including: passing a neck of the liner structure through the discharge spout, wherein the neck is formed of a liner material and encloses a cross-sectional area substantially equal to a cross-sectional area of the discharge spout; constricting a sidewall of the neck, such that a collar formed of the liner material and coupled to the neck encloses a cross-sectional area that is less than the cross-sectional area of the discharge spout; passing the collar through the discharge spout; and releasing the sidewall of the neck to expand the collar.

Figure 1:
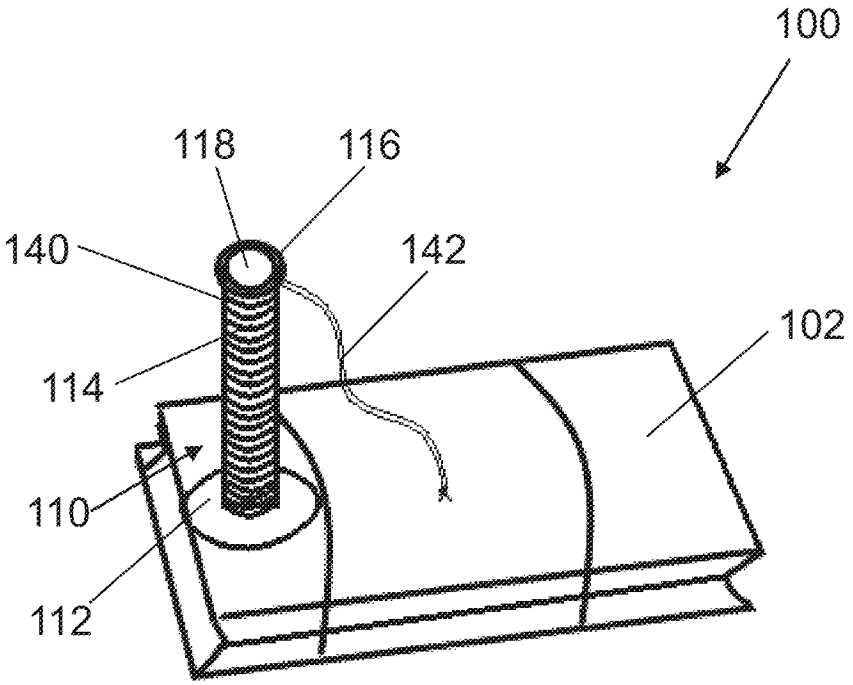
FIG. 1 shows a perspective view of a liner and portion of a discharge spout according to embodiments of the disclosure.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

Figure 2:
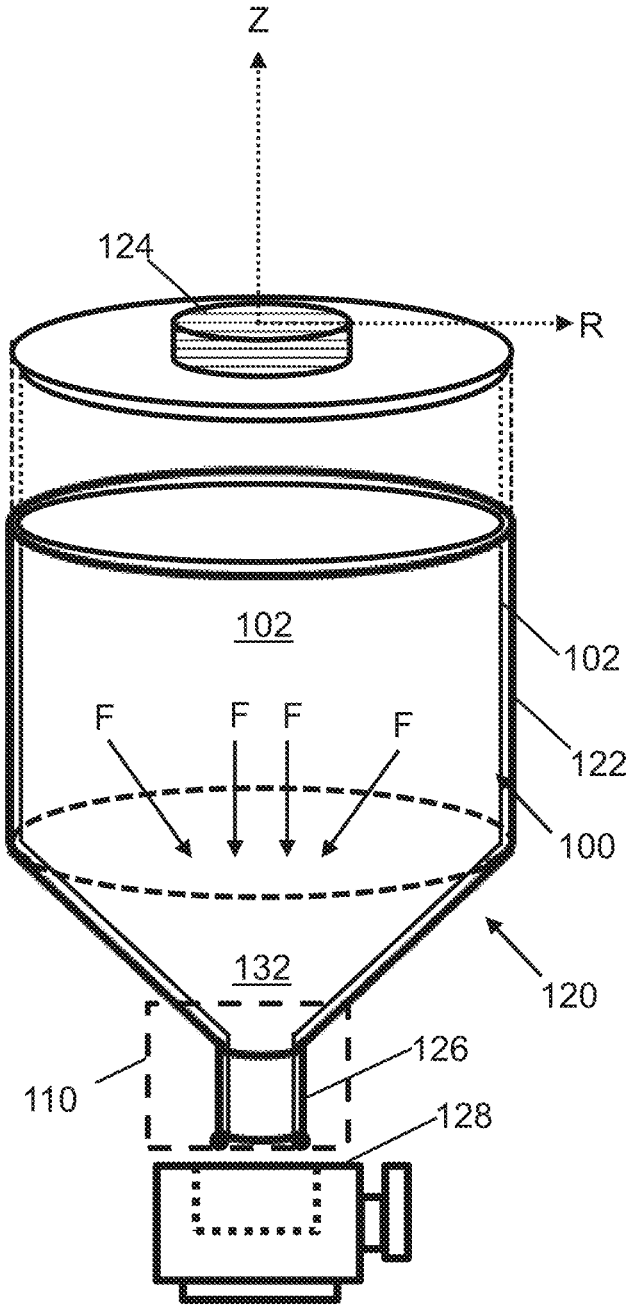
FIG. 2 shows a schematic diagram of a container and a portion of a liner therein according to embodiments of the disclosure.

FIG. 1 depicts a liner structure 100 that may include a liner body 102 coupled to a discharge structure 110 for placement in a discharge opening of a container. An illustrative container 120 including liner structure 100 with discharge structure 110 is shown in FIG. 2. Liner discharge structure 110 is fabricated separately from liner body 102 and is thereafter attached to an opening in a liner body 102 using any technique that does not introduce any foreign material, e.g., heat sealing, vibration welding, ultrasonic welding, etc.

As shown in FIG. 1, liner discharge structure 110 generally includes a substantially rigid liner portion 112, a neck 114, and a collar 116 that is dimensioned to surround an opening 118. Collar 116 may include or otherwise may be in the form of an O-ring, such that collar 116 has an outer diameter larger than neck 114 of discharge structure 110. A feature of liner discharge structure 110 is that its entire structure, except perhaps rigid materials encapsulated within collar 116, may be fabricated from the same material as liner body 102 to which it connects. Collar 116 and neck 114 thus may have a substantially uniform rigidity, and these components moreover may have the same rigidity as substantially rigid liner portion 112 of liner discharge structure 110. Thus, the surface area of liner discharge structure 110 and the surface area of associated liner body 102 is homogeneous to ensure compatibility with fluids contained therein. The use of the same materials eliminates manufacturing challenges, i.e., there are no challenges associated with welding or sealing heterogeneous materials.

The shape of liner discharge structure 110 may depend, along with its associated liner body 102, on the shape of a container 120 (FIG. 2) where it is deployed. For the purposes of this disclosure, the term container may refer to any tank, tote, vessel, etc., that can store fluids. Further, such containers may be fabricated from any material, including PVC, metal, composites, etc. Further details of container 120 are discussed elsewhere herein.

As noted, liner discharge structure 110 generally includes three regions, substantially rigid liner portion 112, neck 114, and collar 116. As described herein, substantially rigid liner portion 112 may have a cross-sectional thickness greater than a cross-sectional thickness of liner body 102 and neck 114. The larger cross-sectional thickness creates a stiffer region of liner material which may prevent liner body 102 from slipping down and interfering with a discharge passage where other portions of discharge structure 110 will be inserted.

Neck 114 may, for example, be fabricated in a substantially tubular arrangement from one or more sections of liner material, e.g., that may be coupled to substantially rigid liner portion 112 by welding, chemical adhesives, and/or other attachment techniques or components. Neck 114 provides a passageway between an opening in substantially rigid liner portion 112 and collar 116. Collar 116 may be fabricated using excess neck liner material along the edge of the neck and/or additional liner material. Collar 116 may include, or fully encapsulate, an O-ring to provide a wider diameter outlet about opening 118. Collar 116, additionally, may have an exterior formed of the same liner material(s) used elsewhere in discharge structure 110.

Referring to FIG. 2, an illustrative container 120 generally includes an inner wall 122, a filling port 124 and a discharge spout 126. Container 120 can be of any size, and more specifically can be provided with any conceivable height and/or length dimension as indicated with partial dashed lines. For the purposes of this disclosure, the term container may refer to any tank, tote, vessel, etc., for storing fluids. Further, such containers may be fabricated from any material, including PVC, metal, composites, etc. Discharge spout 126 can receive a valve 128, e.g., with threading, for controlling an amount of fluid discharge from container 120. Container 120 can be positioned within an external structure (not shown) such as a frame, fixture, etc., for maintaining a desired position and/or orientation of container 120 and components thereof during use. Container 120 is illustrated by example as having a vertically-oriented discharge passage (i.e., discharge spout 126 discussed herein), but it is understood that horizontal and diagonally oriented discharge spouts may be used in other embodiments of container 120. Moreover, container 120 itself may have a variety of geometrical profiles, e.g., spherical, cubic, conic, and/or any conceivable shape in three dimensions. Such attributes of container 120 may depend, in part, on its intended contents based on various technical considerations not discussed herein.

As shown, container 120 can include liner structure 100 therein having liner body 102, a narrowing region 132, and a liner discharge structure 110 (shown in dashed lines), such that a portion of liner structure 100 is seated at least within discharge spout 126. Container 120 and liner 100 can extend substantially along an axial axis "Z," with a radial axis "R" extending outwardly therefrom. Liner body 102 can be shaped and adapted to conform to inner wall 122 during operation, e.g., by being manufactured with substantially the same size, shape, etc., as container 120 where liner structure 100 is used.

The interposition of narrowing region 132 between liner body 102 and liner discharge structure 110 can cause a cross-sectional area of liner structure 100 at liner discharge structure 110 to be less than a cross-sectional area of liner structure 100 within liner body 102 by a predetermined factor, e.g., by an approximately 1:2, 1:4, 1:10 area ratio or by any other desired ratio between areas. Narrowing region 132 can thus have a distinct shape from liner discharge structure 110 and liner body 102, and in an example embodiment can make up at least a partially frustoconical region of liner structure 100. In any event, the size of liner structure 100 at various positions can vary during manufacture based on the size of container 120 where liner structure 100 is used, as indicated with the corresponding dashed lines. Embodiments of the present disclosure can include features of liner discharge structure 110 at discharge spout 126 to aid, e.g., the discharge flow of chemicals from container 120 while reducing the amount of slipping or other dislocations of liner structure 100 from container 120.

Although liner structure 100 is shown as being separated from inner wall 122, discharge spout 126, etc., in FIG. 2 for clarity of illustration, it is understood that liner structure 100 and components thereof can structurally conform to the dimensions of container 120 using known techniques. For example, where liner structure 100 is composed of a pliable material such as a polymer compound, the various components of liner structure 100 can take up substantially no space, e.g., by having a thickness of less than approximately 1.0 centimeters (cm) and thereby cause substantially no reduction in the capacity of container 120.

Referring to FIGS. 1 and 2 together, substantially rigid liner portion 112 surrounds opening 118 to increase structural support of liner body 102, e.g., because substantially rigid liner portion 112 is thicker (and thus more rigid) than liner body 102, substantially rigid liner portion 112 helps ensure that other portions of liner body 102 in container 120 and/or discharge spout 126 will not slide down, collapse, etc. The rigidity provided by substantially rigid liner portion 112 helps to offset any sliding that could block passageways within and/or coupled to the interior of container 120.

Furthermore, because liner discharge structure 110 is fabricated from the same material as the liner body 102 itself, no nonconforming materials are introduced despite any differences in material rigidity. Use of the same material also allows liner discharge structure 110 to be easily attached to the liner body 102 with known techniques. In a typical embodiment, the liner material may comprise a multilayer substrate having properties compatible with the fluid to be placed in container 120. Accordingly, selection of the liner material may change from application to application. Using the same liner material(s) for liner body 102 and liner discharge structure 110 ensures a homogeneous containment environment.

Embodiments of the disclosure provide additional features of liner discharge structure 110, e.g., to allow liner discharge structure to pass through discharge spout 126 even where collar 116 is of a wider diameter than discharge spout 126. Embodiments of liner discharge structure 110, discussed herein, may include neck 114 formed of the liner material and shaped to enclose a cross-sectional area that is approximately equal to the internal cross-sectional area of discharge spout 126. As discussed in more detail elsewhere herein, collar 116 may be formed of the liner material while being coupled circumferentially to an end of neck 114, in which collar 116 encloses a cross-sectional area greater than discharge spout 126. A constrictable sidewall 140 on neck 114 may be proximate collar 116, allowing compression of collar 116 such that it is temporarily within the cross-sectional area of discharge spout 126. A fastener 144 (e.g., a clip formed of deformable materials such as metals, ceramics, etc., a string, a slip, and/or other fastening instruments) may be circumferentially coupled to constrictable sidewall 140, e.g., to aid a user in temporarily constricting and expanding constrictable sidewall 140. Fastener 144 may include materials such a sealing adhesive (e.g., polytetrafluoroethylene (PTFE)) metal(s), ceramic(s), the liner material, and/or other currently known or later developed substances. Constrictable sidewall 140 may be shaped such that collar 116 is compressible to a cross-sectional area that is at most equal to the cross-sectional area of discharge spout 126. Embodiments of liner discharge structure 110 are configured for applications in which discharge spout 126 is coupled to various types of valves and/or discharge piping for transmitting fluids from within container 120. Related methods of the disclosure may include, e.g., removing one or more valves and/or piping sections, passing liner discharge structure 110 through such piping and/or valves while sidewall 14 is constricted, and coupling collar 116 to the exterior of the piping and/or valve(s) using, e.g., a quick disconnect piping connection and/or other structure.

Figure 3:
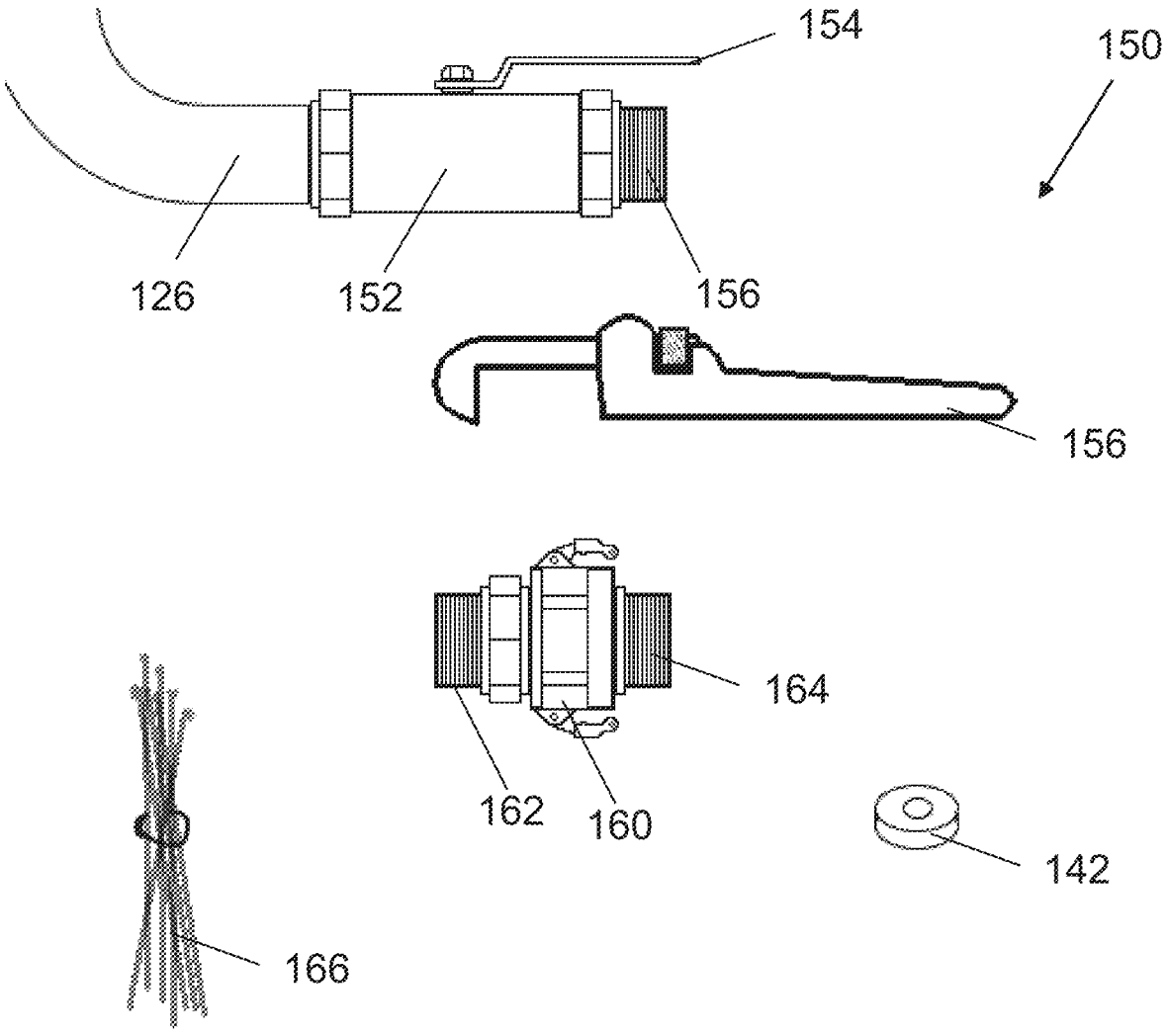
FIG. 3 shows a discharge spout and a kit for installing a liner within a discharge spout and valve according to embodiments of the disclosure.
Figure 4:
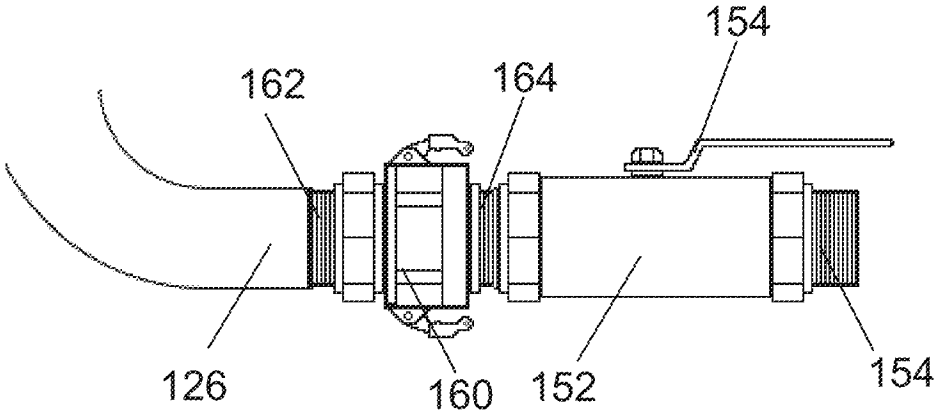
FIG. 4 shows a side view of a tank discharge spout and valve with the liner installed therein according to embodiments of the disclosure.

FIG. 3 depicts an example of a kit 150 for coupling liner discharge structure 110 and various forms of valves and/or piping to discharge spout 126. Initially, discharge spout 126 may be coupled to a pipe 152 through, e.g., a threaded junction and/or physical coupling for interconnecting discharge spout to pipe 152. Pipe 152 optionally may include a quick release connection 154 e.g., for manual detachment and reattachment of pipe 152 to discharge spout 126. Quick release connection 154 is shown by example to be in the form of a cam lock quick release connection for coupling pipe 152 to discharge spout 126. In further examples, quick release connection 154 may be adapted for Derry fittings, I-line fittings, and/or any other currently known or later developed coupling of two or more sections of piping (e.g., via a valve). A wrench 156 additionally may be used to actuate pipe 152 during detachment and/or attachment of pipe 152 to/from discharge spout 126. Pipe 152 additionally may include an end 156 for coupling to other piping members and/or various types of fluidly coupled components. An intermediate coupling 160, e.g., a valve fitting, additional piping section, and/or other component for being fluidly intercoupled between discharge spout 126 and pipe 152, may include a first end 162 and a second end 164. First end 162 may be shaped for coupling to discharge spout 126 whereas second end 164 may be shaped for coupling to pipe 152, although the positions and/or functions of each end 162, 164 may be modified in further implementations. Embodiments of the disclosure allow liner structure 100 including liner discharge structure 110 to pass through discharge spout 126, intermediate coupling 160, and optionally pipe 152 despite collar 116 thereof possibly having a larger diameter than discharge spout 126, intermediate coupling 160, and/or pipe 152. Kit 150 may include a set of rods 166, e.g., for moving portions of discharge structure 110 through discharge spout 126, intermediate coupling 160, and/or pipe 152.

Installation of liner discharge structure 110 in discharge spout 126, intermediate coupling 160, and/or pipe 152 may include using kit 150 to pass liner discharge structure 110 through discharge spout 126, intermediate coupling 160, and/or pipe 152. This process may seal discharge spout 126 as well as liner discharge structure 110, thus preventing any leakage. Conventional liner structures are inoperable for use in this manner because conventional discharge spouts have a relatively small inside diameter restricting the flow rate of the material leaving the tank. Additionally, conventional spouts are made of material dissimilar to the liner material.

This creates an additional challenge of meeting chemical compatibility issues with the respective container(s) and/or liner(s).

Figure 5:
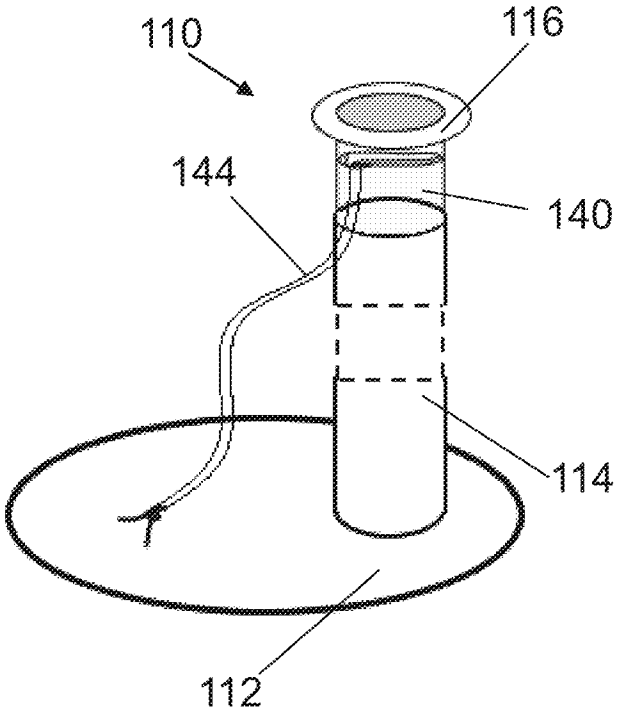
FIG. 5 shows a perspective view of a liner and discharge spout according to embodiments of the disclosure.
Figure 6:
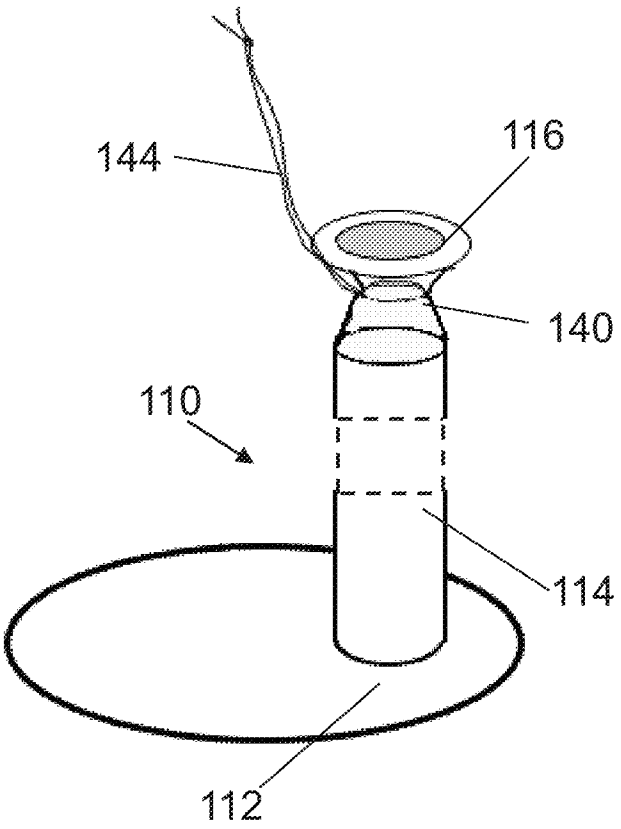
FIG. 6 shows a first perspective view of a liner discharge spout being prepared for installation according to embodiments of the disclosure.

FIGS. 5 and 6 depict an example of liner discharge structure 110, in which FIG. 5 depicts liner discharge structure 110 in a non-constricted state and FIG. 6 depicts liner discharge structure 110 in a constricted state. Portions of neck 114 are shown with dashed lines to show that length of neck 114 may be fabricated to have a wide variety of lengths. In the non-constricted state shown in FIG. 5, liner discharge structure 110 is shaped such that product(s) within liner discharge structure 110 can flow as quickly as possible. A technical concern generally associated with liner discharge structure 110 being in this state is generally increased difficulty in pulling the liner material through discharge spout 126 and interconnected piping.

Using fastener 144 on constrictable sidewall 140, an operator may constrict liner discharge structure 110 and thus increase the flexibility of collar 116, thereby allowing liner discharge structure 110 to pass through smaller surface areas than possible when sidewall 140 is not constricted. In implementations where fastener 144 includes, e.g., an adhesive tape, fastener may be knotted or otherwise closed about constrictable sidewall 140 to maintain the reduced surface area in neck 114. Reducing the surface area of neck 114 using constrictable sidewall 140 and fastener 144 may allow collar 116 to deform into a shape and cross-sectional area that allows liner discharge structure 110 to pass through discharge spout 126, intermediate coupling 160, and/or pipe 152. Constrictable sidewall 140 and fastener 144, in addition, may allow a uniform composition of liner material to be used for interior surfaces of neck 114 and collar 116.

Figure 7:
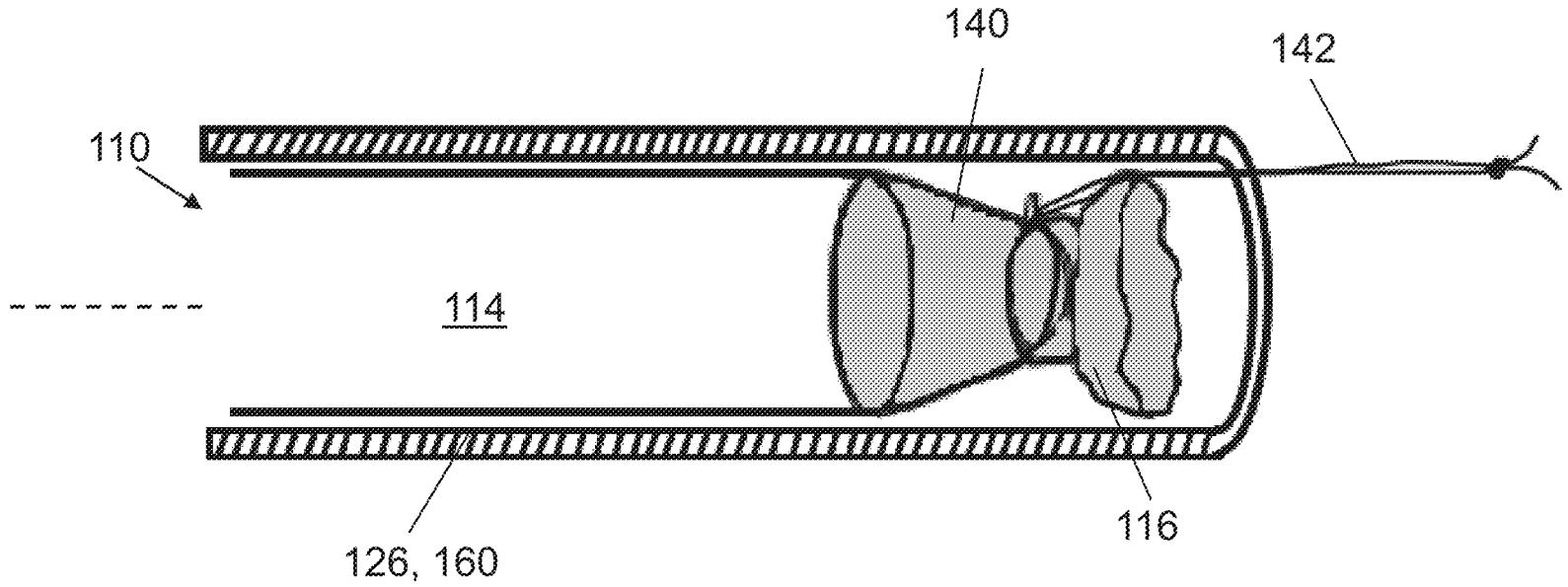
FIG. 7 shows a cross-sectional view of a constricted collar within a discharge spout according to embodiments of the disclosure.
Figure 8:
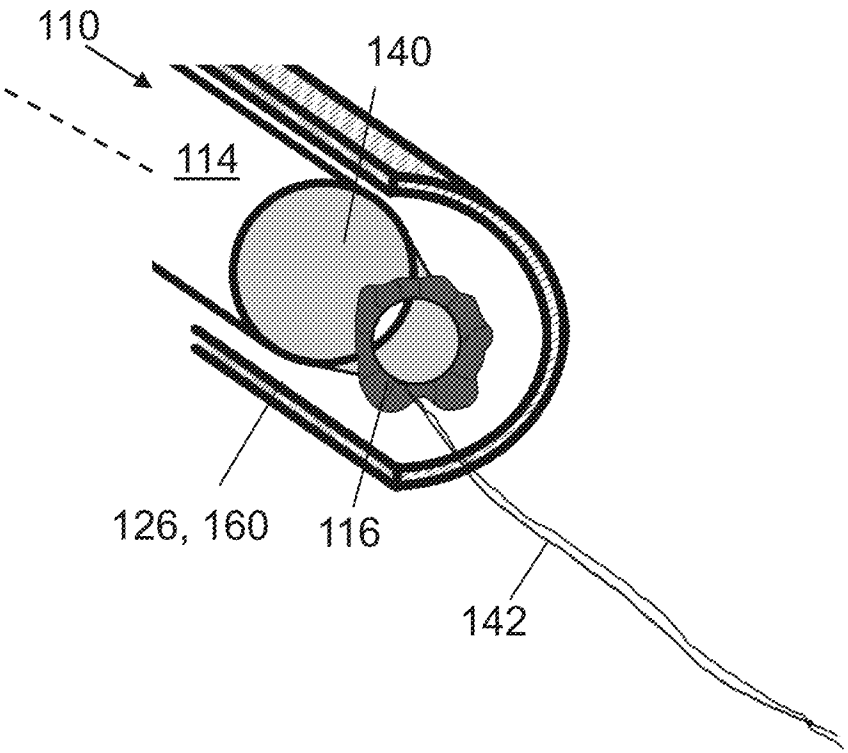
FIG. 8 shows a cut away perspective view of a constricted collar within a discharge spout according to embodiments of the disclosure.

FIGS. 7 and 8 depict methods of passing liner discharge structure 110 through portions of discharge spout 126 and/or intermediate coupling 160 according to embodiments of the disclosure. Such processes may be aided in part by various elements of kit 150 (FIG. 3) discussed herein including, e.g., wrench 156 (FIG. 3) for joining discharge spout 126 to intermediate coupling, rods 166 (FIG. 3) for guiding liner discharge structure through discharge spout 126 and/or intermediate coupling 160, and/or fastener 144 for reducing the surface area of neck 114 via constrictable sidewall 140. Additional components may be used to install liner body 102 according to conventional techniques before guiding liner discharge structure 110 through discharge passage 126. With liner body 102 positioned inside container 120, fastener 144 can reduce the surface area of liner discharge structure 110 (e.g., using constrictable sidewall 140). Neck 114 and collar 116 then can be guided through discharge spout 126 (e.g., using rods 166) and subsequently through intermediate coupling 160.

When collar 116 reaches a desired location (e.g., the junction between second end 164 of intermediate coupling 160 and pipe 152), fastener 144 can be loosened (e.g., by being removed, untied, etc.) to expand constrictable sidewall 140 of neck 114. This process allows maintaining of the tight fit between liner discharge structure 110 and discharge spout 126 or intermediate coupling 160 as liner discharge structure 110 passes therethrough. Once expanded, collar 116 can provide a proper connection to adjacent components, e.g., using quick release connection 154 (FIG. 3) and/or other fluid coupling mechanisms. After constrictable sidewall 140 is re-expanded, collar 116 may be positioned directly between, and may be in contact with, two fluidly coupled components, e.g., between second end 164 of intermediate coupling 160 and a corresponding end of pipe 152.

Once liner discharge structure 110 is installed within discharge spout 126, collar 116 may rest against adjoining surfaces, e.g., those coupled and decoupled using quick release connection 154 (FIG. 3) to seal the material composition of liner structure 100 and prevent leakage from container 120. Liner discharge structure 110 may have any desired dimension to accommodate various sizes of discharge spouts 126 and interconnected components. In discharge spouts 126 with larger outer diameter size, less clearance is available to move correspondingly sized collars 116 through discharge spouts 126 of the same cross-sectional area. Conversely, discharge spouts 126 of smaller outside diameter are more restrictive of product(s) flowing therethrough. In either situation, however, embodiments of liner discharge structure 110 with constrictable sidewall 140 remain flexible and capable of accommodating variously sized discharge spouts 126 and/or interconnected components.

Once liner structure 100 including liner discharge structure 110 thereof is installed within container 120, pumping the contents of container 120 through liner discharge structure 110 creates a low-pressure area within liner discharge structure 110 and discharge spout 126. Conventionally, such a low-pressure area creates a risk of collapsing liner material(s) within discharge spout 126 and restricts or prevents discharge from container 120. However, liner discharge structure 110 and its material composition prevent such a low-pressure region from collapsing the liner material(s) within discharge spout 126. Furthermore, constrictable sidewall 140 may allow materials of larger cross-sectional area to be used, and thus withstand any vacuum created while discharging materials from container 120 through discharge spout 126.

Embodiments of the disclosure provide several technical and commercial advantages, some of which are discussed herein as examples. Liner discharge structure 110 according to the disclosure ensures that only chemically compatible materials of compatible size are used in construction of liner structure 100, including discharge structure 110 and collar 116 thereof. Embodiments of the disclosure provide a relatively simplified installation method as compared to other approaches to install a container liner at the junction between a discharge spout and interconnected component (e.g., valve). Moreover, embodiments of the disclosure provide an improved flow of product through discharge spout 126 through ensuring a wider diameter of liner discharge structure 110 within discharge spout 126. Various characteristics of liner structure 100 according to the disclosure will prevent liner structure 100 from collapsing within discharge spout 126 when container 120 is emptied. Embodiments of the disclosure are not limited for use with only a particular size and shape of tank and are operable for discharge spouts in a wide variety of shapes and sizes.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A liner structure adapted for insertion within a discharge spout of a container, the liner structure comprising:
- a neck formed of a liner material, and enclosing a cross-sectional area substantially equal to a cross-sectional area of the discharge spout;
- a collar formed of the liner material and coupled circumferentially to an end of the neck, wherein the collar has a cross-sectional area greater than the cross-sectional area of the discharge spout; and
- a constrictable sidewall on the neck proximate the collar, wherein constricting the constrictable sidewall compresses the collar such that the collar is within the cross-sectional area of the discharge spout.

2. The liner structure of claim 1, wherein the collar is directly between the discharge spout of the container and a valve fluidly coupled to the discharge spout of the container.

3. The liner structure of claim 1, wherein at least a portion of the neck contacts a valve coupled to the discharge spout.

4. The liner structure of claim 3, wherein the collar is shaped for insertion between the valve and an adjacent pipe.

5. The liner structure of claim 1, further comprising a substantially rigid liner portion having an opening to the neck, wherein a material composition of the substantially rigid liner portion includes the liner material.

6. The liner structure of claim 5, wherein the substantially rigid liner portion is coupled to a liner body formed of the liner material.

7. The liner structure of claim 5, wherein the liner material of the collar and the neck has a substantially uniform rigidity that is less than a rigidity of the substantially rigid liner portion.

8. A liner structure adapted for insertion within a discharge spout of a container, the liner structure comprising:
- a neck formed of a liner material, and enclosing a cross-sectional area substantially equal to a cross-sectional area of the discharge spout;
- a collar formed of the liner material and coupled circumferentially to an end of the neck, wherein the collar has a cross-sectional area greater than the cross-sectional area of the discharge spout; and
- a constrictable sidewall on the neck proximate the collar, the constrictable sidewall adjustable between:
  - a first position in which the constrictable sidewall encloses the cross-sectional area of the discharge spout, and the collar extends perpendicularly outward with respect to the neck, and
  - a second position in which the constrictable sidewall encloses less than the cross-sectional area of the discharge spout, and the collar is constricted such that an outer circumference of the collar is within the cross-sectional area of the discharge spout.

9. The liner structure of claim 8, wherein the collar is directly between the discharge spout of the container and a valve fluidly coupled to the discharge spout of the container.

10. The liner structure of claim 8, wherein at least a portion of the neck contacts a valve coupled to the discharge spout.

11. The liner structure of claim 10, wherein the collar is shaped for insertion between the valve and an adjacent pipe.

12. The liner structure of claim 8, further comprising a substantially rigid liner portion having an opening to the neck, wherein a material composition of the substantially rigid liner portion includes the liner material.

13. The liner structure of claim 12, wherein the substantially rigid liner portion is coupled to a liner body formed of the liner material.

14. The liner structure of claim 12, wherein the liner material of the collar and the neck has a substantially uniform rigidity that is less than a rigidity of the substantially rigid liner portion.

15. A method to install a liner structure within a discharge spout of a container, the method comprising:
- passing a neck of the liner structure through the discharge spout, wherein the neck is formed of a liner material and encloses a cross-sectional area substantially equal to a cross-sectional area of the discharge spout;
- constricting a sidewall of the neck, such that a collar formed of the liner material and coupled to the neck encloses a cross-sectional area that is less than the cross-sectional area of the discharge spout;
- passing the collar through the discharge spout; and
- releasing the sidewall of the neck to expand the collar.

16. The method of claim 15, wherein passing the collar through the discharge spout includes passing the collar through a valve coupled to the discharge spout.

17. The method of claim 16, further comprising mechanically inserting the collar between the valve and an adjacent pipe.

18. The method of claim 16, wherein releasing the sidewall of the neck to expand the collar includes positioning the collar between the valve and an adjacent pipe.

19. The method of claim 15, wherein releasing the sidewall of the neck to expand the collar causes the collar to expand to a cross-sectional area that is greater than the cross-sectional area of the discharge spout.

20. The method of claim 15, further comprising positioning a liner body within the container, wherein the liner body is fluidly coupled to the neck and includes a substantially rigid liner portion adjacent an opening to the neck.

* * * * *